United States Patent [19]

Sherman, Jr.

[11] Patent Number: 4,774,739

[45] Date of Patent: Oct. 4, 1988

[54] DRAIN CLEANOUT TOOL

[76] Inventor: Irving E. Sherman, Jr., P.O. Box 34619, Fort Buchanan, P.R., 00934

[21] Appl. No.: 41,688

[22] Filed: Apr. 23, 1987

[51] Int. Cl.[4] ..... B08B 9/02

[52] U.S. Cl. ..... 15/104.33; 254/134.3 FT

[58] Field of Search ..... 15/104.3 R, 104.3 SN, 15/104.3 G; 254/134.3 FT; 294/86.4, 82.18

[56] References Cited

U.S. PATENT DOCUMENTS

| | | | |
|---|---|---|---|
| 1,588,737 | 6/1926 | Hurd | 15/104.3 SN |
| 3,192,617 | 7/1965 | Meyer | 254/134.3 FT |
| 3,330,533 | 7/1967 | Blume | 254/134.3 FT |
| 4,083,532 | 4/1978 | Pola | 254/134.3 FT |

FOREIGN PATENT DOCUMENTS

| | | | |
|---|---|---|---|
| 249078 | 3/1948 | Switzerland | 15/104.3 SN |

*Primary Examiner*—Edward L. Roberts

*Attorney, Agent, or Firm*—Leon Gilden

[57] ABSTRACT

A drain cleanout tool includes a spring cable having an attached head which retains a web of tangled monofilament line. The spring cable is directed down a clogged drain in a conventional manner, and the tangled web of monofilament line will then become entangled with the object trapped in the drain. The object can then be withdrawn to unclog the drain.

4 Claims, 3 Drawing Sheets

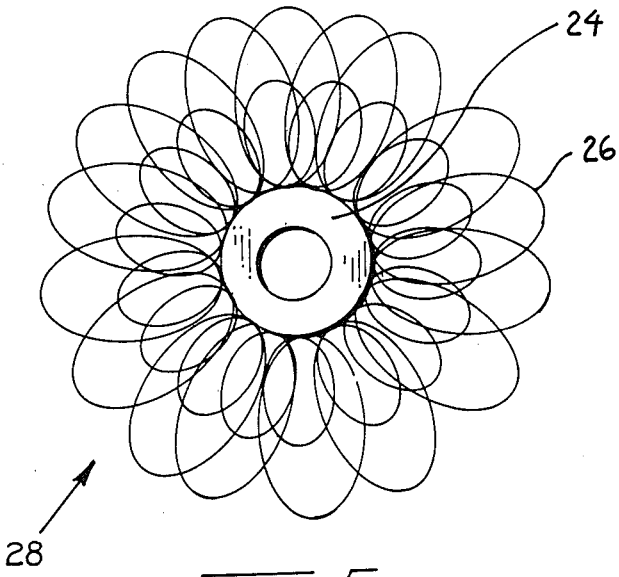
FIG 5
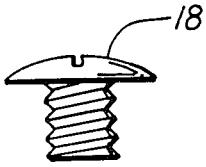
FIG 6
FIG 2
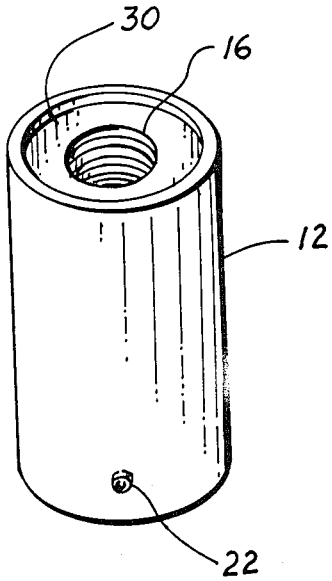

DRAIN CLEANOUT TOOL

BACKGROUND OF THE INVENTION

1. Field of the Invention

The present invention relates to drain cleanout devices, and more particularly pertains to a new and improved drain cleanout tool which utilizes a tangle of monofilament line to effectively entangle an object trapped within a clogged drain.

2. Description of the Prior Art

Use of various spring cable devices for cleaning out clogged drains is well known in the prior art. Typically, the devices are referred to as "snakes", and they usually include a length of spring cable which can be guidingly forced downwardly into a clogged drain. In a conventional form, a spring cable is provided with a head member usually formed in the shape of a helically wound length of rigid wire so that a forceful ejectment of an entrapped item can be accomplished. Such prior art devices are not designed to ensnare and remove a trapped object, but are rather designed to force the object through the trap or some other clogged portion of a pipe with the hope being that the object will then move freely through the pipe and into the sewer system. As can be appreciated, it is a distinct disadvantage that the prior art drain cleanout tools are not designed to remove entrapped objects from a drain line. More specifically, the forcing of a trapped object deeper into a clogged drain line may create serious problems if the object does not break loose and freely move into the sewer system. Inasmuch as all of the known prior art drain cleanout tools rely upon the principle of forcing an entrapped object into the sewer system, there appears to be a need for some type of cleanout device which would effectively ensnare and remove an object from a drain line so as to eliminate the necessity of forcing the object into the existing sewer system. In this regard, the present invention addresses this need.

SUMMARY OF THE INVENTION

In view of the foregoing disadvantages inherent in the known types of drain cleanout devices now present in the prior art, the present invention provides an improved drain cleanout tool wherein the same is designed to ensnare and remove a trapped object within a clogged drain without the necessity of forcing the object deeper into the associated drain line. As such, the general purpose of the present invention, which will be described subsequently in greater detail, is to provide a new and improved drain cleanout tool which has all the advantages of the prior art drain cleanout tools and none of the disadvantages.

To attain this, the present invention comprises a length of spring cable having a free end on which a specially manufactured head is attached. The head includes an attached head to which a plurality of tangled monofilament line is connected, and this gathered amount of substantially continuous monofilament line is utilized to entangle a trapped object within a clogged drain and to remove the same through a concurrent removal of the spring cable.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drain cleanout tool which has all the advantages of the prior art drain cleanout tools and none of the disadvantages.

It is another object of the present invention to provide a new and improved drain cleanout tool which may be easily and efficiently manufactured and marketed.

It is a further object of the present invention to provide a new and improved drain cleanout tool which is of a durable and reliable construction.

An even further object of the present invention is to provide a new and improved drain cleanout tool which is susceptible of a low cost of manufacture with regard to both materials and labor, and which accordingly is then susceptible of low prices of sale to the consuming public, thereby making such drain cleanout tools economically available to the buying public.

Still yet another object of the present invention is to provide a new and improved drain cleanout tool which provides in the apparatuses and methods of the prior art some of the advantages thereof, while simultaneously overcoming some of the disadvantages normally associated therewith.

Still another object of the present invention is to provide a new and improved drain cleanout tool which is particularly designed to remove an entrapped object from a drain line rather than to force the object on through the line into an existing sewer system.

Yet another object of the present invention is to provide a new and improved drain cleanout tool which provides for the easy removal of small objects, such as toothbrushes, toys, and the like, from drain traps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a perspective view of the head forming a part of the present invention.

FIG. 5 is a top plan view of the washer and line assembly comprising a part of the present invention.

FIG. 6 is a side elevation view of an attachment screw utilized in the combination of the invention.

DESCRIPTION OF THE PREFERRED EMBODIMENT

Figure 1:
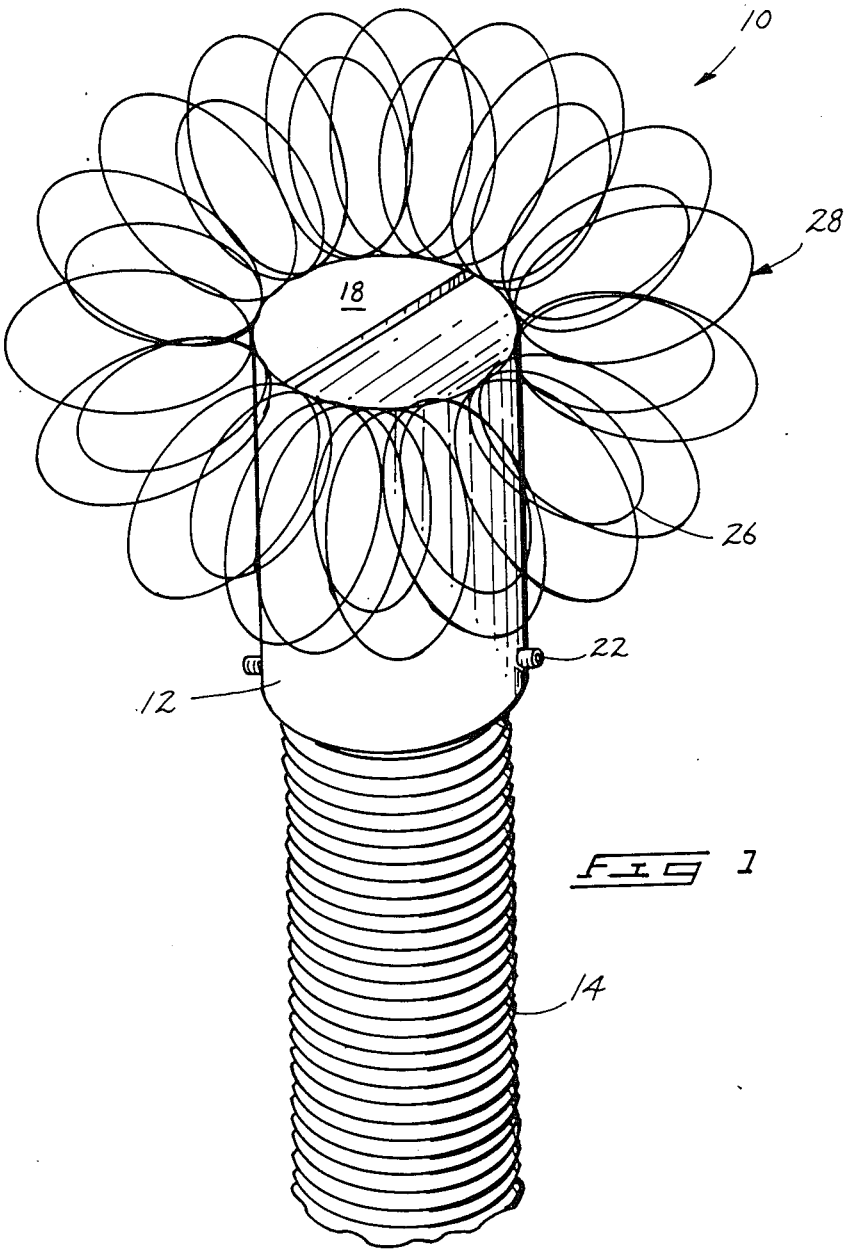
FIG. 1 is a perspective view of the drain cleanout tool comprising the present invention.
Figure 3:
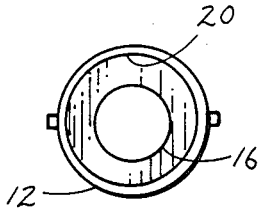
FIG. 3 is a bottom plan view of the head.

With reference now to the drawings, and in particular to FIGS. 1–6 thereof, a new and improved drain cleanout tool embodying the principles and concepts of the present invention and generally designated by the reference numeral 10 will be described.

More specifically, it will be noted that the drain cleanout tool 10 includes an object entrapping head portion 12 operably attached to a flexible spring cable 14. The head 12 is of a cylindrical design and includes a first axially aligned, internally threaded aperture 16 designed to receive a machine screw 18. Additionally, the head 12 includes a second axially aligned aperture 20 extending inwardly from an opposed end of the head. The second aperture 20 is designed to receive the aforementioned spring cable 14, while a plurality of set screws 22 are radially directed through the head 12 so as to serve as a means for effecting a secure attachment of the spring cable to the head.

Figure 4:
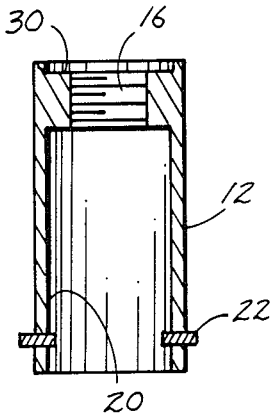
FIG. 4 is a cross-sectional elevation view of the head.

As shown in FIG. 4, the two axially aligned apertures 16, 20 may come together in axial alignment so as to form a through-extendeing bore through the head 12 or alternatively, each of these apertures could extend inwardly within the head for only a short distance whereby a through-extending bore is not formed. As such, all conceivable designs and constructions of the head 12 which would include the two apertures 16, 20 are within the intent and purview of the present invention.

As further illustrated in the drawings, a washer-like member 24 may be constructed from some known material, such as plastic, metal, or the like, and includes a large entanglement of monofilament line loops 26 attached thereto. The attachment of the monofilament line entanglement 26 to the washer member 24 would desirably be by some conventional means which would allow the invention to function in the intended manner. In a preferred embodiment, one or more continuous strands of monofilament line 26 could be looped repeatedly around the washer member 24 and adhesively or otherwise attached thereto to form an object entrapping web 28 as best illustrated in FIGS. 1 and 5.

As to the manner of usage and operation of the present invention, the same should be apparent from the above description. However, a brief summary thereof will be provided. More specifically, it will be noted that the washer-like member 24 is positionable within a depression 30 forming a part of the head 12, and the machine screw 18 can then be threadably engaged with the aperture 16 to effect a secure retention of the object entrapping web 28 to the head. By the same token, the head 12 is secured to the spring cable 14 by means of the set screws 22 which then defines the completely assembled invention. When a object such as a toothbrush, toy, comb, or the like becomes entrapped in a drain, a user of the invention 10 can direct the web 28 downwardly into the drain by means of the spring cable 14 in a conventional manner. Once the web 28 is positioned proximate the entrapped object, a manual rotation of the spring member 14 will effect an entanglement of the object with the monofilament line loops 26. The entrapped object can then be withdrawn from the drain.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved drain cleanout tool comprising:

web means positionable proximate an entrapped object within said drain, said web means being designed to become entangled with said object so as to effect an attachment thereto; and flexible directing means comprising a spring cable means for directing said web means through said drain so as to bring said web means into engagement with said entrapped object; and said web means includes a head member attached to said flexible directing means, said head member having a plurality of flexible members attached thereto, wherein said flexible members comprise loops of monofilament line; and said loops are attached to a washer-like member which is removably attached to said head member.

2. The new and improved drain cleanout tool as described in claim 1, wherein said washer-like member is attached to said head member by a threaded fastener.

3. The new and improved drain cleanout tool as described in claim 2, wherein said flexible directing means comprises a spring cable means.

4. The new and improved drain cleanout tool as described in claim 3, wherein said head member is attached to said spring cable means by set screws.

* * * * *